United States Patent [19]

Susman

[11] 4,172,426

[45] Oct. 30, 1979

[54] FOLDING OUTRIGGER RELEASABLE BRACE FOR TRIMARAN

[76] Inventor: Leonard Susman, 1710 SE. 12th Ter., Cape Coral, Fla. 33904

[21] Appl. No.: 892,025

[22] Filed: Mar. 31, 1978

[51] Int. Cl.[2] ..... B63B 43/14

[52] U.S. Cl. ..... 114/61; 114/123

[58] Field of Search ..... 114/39, 61, 122, 123, 114/126, 102, 112, 213, 215, 216, 217; 254/65, 135 CE, 149, 161, 172; 214/506; 280/414 R

[56] References Cited

U.S. PATENT DOCUMENTS

| | | | |
|---|---|---|---|
| 1,683,276 | 9/1928 | Woods | 114/61 |
| 2,736,568 | 2/1956 | Martin | 280/414 R |
| 3,937,166 | 2/1976 | Lindsay | 114/61 |
| 3,960,102 | 6/1976 | Davy | 114/61 |
| 3,996,874 | 12/1976 | Winch | 114/61 |

*Primary Examiner*—Trygve M. Blix
*Assistant Examiner*—Jesus D. Sotelo
*Attorney, Agent, or Firm*—Flynn & Frishauf

[57] ABSTRACT

Outriggers of a trimaran mounted on hinged arms for swinging from a sailing position to an alongside position are braced in sailing position in each case by a tension cable having its ends fixed with respect to the outrigger at the connection with the arms and its center detachably fastened to an eye affixed to the main hull. Each tension cable is tightened by a bridle bridging the midpoint of the cable pulled towards the outrigger by a tackle of which the free end is secured to the main hull. If the point at which the middle of the tension cable is secured to the main hull is lower than the places where the ends of the cable are anchored, tightening the tension cable tends to relieve the arms of strains produced by the buoyancy of the lee outrigger.

7 Claims, 7 Drawing Figures

FOLDING OUTRIGGER RELEASABLE BRACE FOR TRIMARAN

This invention concerns a bracing tension cable with tightening tackle for setting up, in their most extended position, the swinging arms of a folding-type trimaran sailboat for securing the outriggers of the boat in their sailing position and for releasing the arms and outriggers in a simple fashion in order to bring the outriggers alongside for docking, for road transportation or for storage of the boat.

The smaller sailboats that are big enough to include overnight accomodations for two to five people are frequently built with a maximum width (beam) of 8 feet so that they can be transported on trailers over streets and highways without a wide-load permit (the limit in Europe is slightly greater, namely 2.5 meters). Trimarans and catamarans, because they carry no ballast and are consequently light in weight for their size, would lend themselves easily to road transportation except for the fact that their sailing width is so great that they must be taken apart in order to provide a load on the trailer within the 8-foot width limitation. Demountable trimarans, with arms and outriggers that can be disconnected from the main hull and stacked above it for storage or road haulage are quite practical, but the processes of assembly and demounting consume enough time and effort to discourage taking the boat by road to a distant location when it is intended to use it there only for a few days, particularly since the assembly and demounting usually must be performed near the launching location where there may be many other boats desiring to use the launching ramp and the nearby access spaces. The problem is not so severe in the case of hauling out for storage or repairs, because the assembly or disassembly can then be more easily scheduled to avoid interference with the use of the launching facilities by boats that do not require much time for rigging and unrigging.

Folding type trimarans with telescoping or swinging arms have been constructed to enable the beam of the craft to be reduced for docking in a marina, for which purpose reduction of beam to 10 or even 12 feet is usually enough. It has also been proposed (U.S. Pat. No. 3,996,874) to swing the outriggers of a trimaran either in a vertical plane (FIGS. 1–5) or in a horizontal plane (FIG. 19) to redistribute buoyancy in emergency situations. A variety of systems have been used for operating the movable parts of a folding trimaran and for bracing the outriggers in their sailing position.

THE PRESENT INVENTION

It is an object of the present invention to provide a better system for controlling swinging arms of a folding trimaran that is simple and light enough for use in a relatively small cruising sailboat, is easily set up or released, and provides for firm bracing of the outriggers without the necessity of inserting rigid bracing members. It is a further object of the invention to provide such an arrangement in a form in which it can also be used for securing the outriggers in their alongside position.

Briefly, a bracing cable is provided for each outrigger that has its ends respectively connected at a forward location and an aft location on the outrigger, preferably at or near the places where the outrigger is pivoted on the respective swinging arms that position it, and the middle of the cable is detachably connected, as by a shackle, to an eye or other fastening member on the main hull. A running bridle is provided for tightening the previously mentioned cable, being connected near the mid portion of the latter, and a tackle pulls the middle of the bridle towards a location on the outrigger substantially midway between the cable ends, the fall of the tackle being secured on the main hull. Release of the tackle, by uncleating or the like, will loosen the cable just enough to allow the middle of the cable to be detached easily from its fastening on the main hull, after which the mid-portion of the cable can easily be pulled to swing the outrigger alongside (preferably swinging it backward for that purpose).

If the point of attachment of the bracing cable to the main hull is located at a level considerably lower than the points of attachment of the ends of the cable to the outrigger, the bracing cable can serve to relieve the hinged arms that position the outrigger from strains imposed by the buoyancy of the outrigger when the latter is forced downward into the water while the boat is sailing.

DESCRIPTION OF THE ILLUSTRATIVE EXAMPLES

Figure 1:
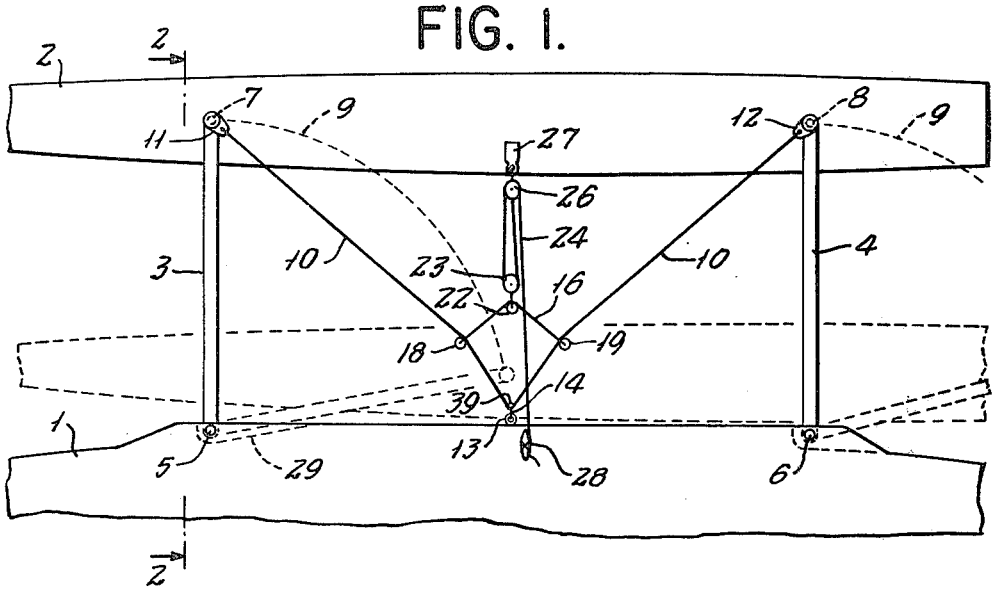
FIG. 1 is a diagrammatic plan view of a tension cable system for setting up an outrigger of a folding trimaran in accordance with the invention.

FIG. 1 shows the lateral boundary of the main hull 1 and the outline of the top of an outrigger 2 held in sailing position by the swinging arms 3 and 4. The forward arm 3 is pivoted on a hinge on the main hull at 5. The outrigger 2 is pivoted on the outer end of the arm 3 by means of a pivot rod 7. The arm 4 has a hinge pivot at 6 at the main hull and a similar pivot 8 on the outrigger 2.

The arms 3 and 4 could be arranged to swing either forward or back to bring the outrigger 23 alongside the main hull 1. It is preferred, as in the illustrated case, to bring the outrigger alongside by swinging the arms 3 and 4 aft as indicated by the broken arcs 9, thus bringing the outrigger 2 into the position 2*a* shown in broken lines in FIG. 1.

Figure 4:
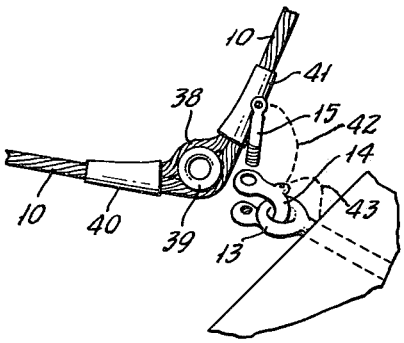
FIG. 4 is an exploded perspective view showing in detail how the bracing cable is detachably connected to the main hull system of FIG. 1.

The arms 3 and 4 are maintained in the sailing position shown in FIG. 1 by means of the cable 10. The ends of the cable 10 are secured in the illustrated case around the outrigger pivots 7 and 8, by means of cringles or flat eyes 11 and 12. The middle of the cable, as shown more particularly in FIG. 4, is provided with an eye formed by a cringle 39, which is fastened by an openable link 14 to an eye 13 that is bolted through or otherwise secured to the main hull 1.

For tightening the cable 10 a bridle 16 is provided connected between the single blocks 18 and 19 that ride on the cable 10. Another block 23 rides with a becket 22 on the bridle 16 and forms, together with the block 26 and the fall 24, a tackle of the kind known as a "gun tackle". The block 26 is secured to a pad eye 27 provided on the top or side, as may be the more convenient, of the outrigger 2. The free end of the fall 24 of the tackle is pulled in to a cleat 28 where it is secured to the hull to maintain the cable 10 tight. The bridle 16 distributes the pull of the tackle evenly to both sides of the fastening 13, 14 and squares off the arms 3 and 4 from the hull. Any tendency of one half of the cable 10 to be pulled straight by forces acting on the outrigger 2 relative to the main hull 1 produces by way of the bridle 16 a force tending to stretch the other half of the cable, which also resists yielding.

Figure 2:
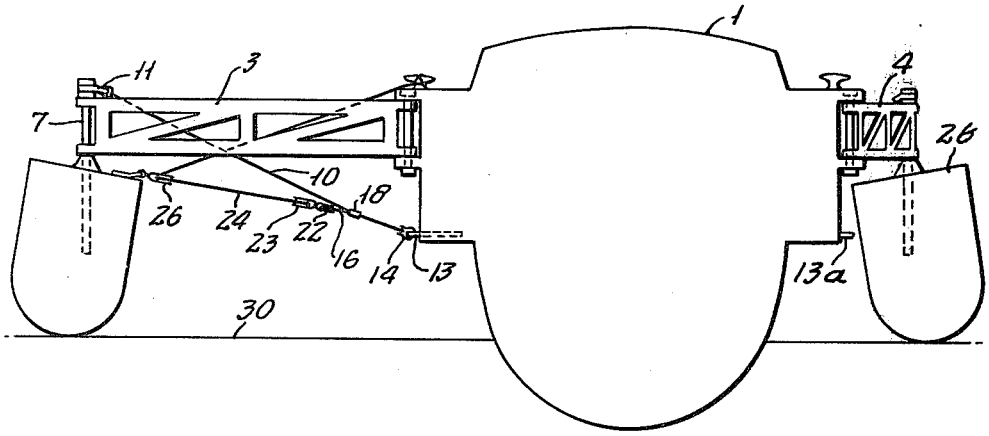
FIG. 2 is a diagrammatic vertical cross-sectional view along the line II—II of FIG. 1, also showing another outrigger in the alongside position (omitting its cable system to simplify the illustration)

As shown in FIG. 2, the eye 13 may be very near the bottom of the so-called wing portion of the main hull 1. Particularly when the eyes 11 and 12 at the ends of the cable 10 are at the top of the respective arms 3 and 4, the cable 10 is able to operate as a diagonal tension brace or "bobstay" against upward forces acting on the ends of the arms 3 and 4. As shown in the right-hand portion of FIG. 2, where the port outrigger **2*b* is shown in its alongside position, the usual 5° off-vertical set of the outrigger results in the outrigger being clear of the eye 13*a* because of the low-down position of the eye 13*a***.

Figure 3:
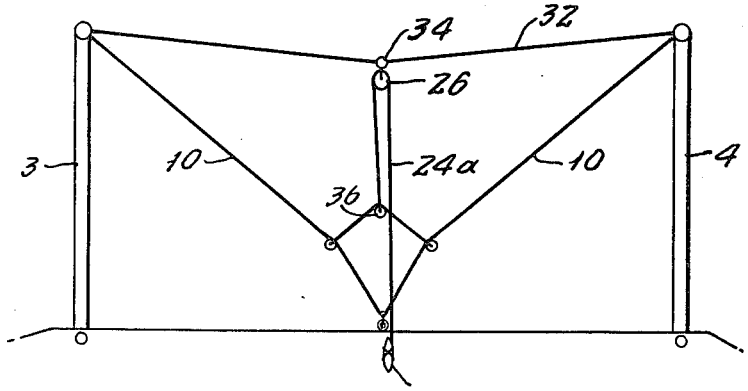
FIG. 3 is a simplified plan view of a variation of the tension cable system of FIG. 1.

FIG. 3 shows that it is not necessary to fasten the block 26 of the tackle directly to the outrigger, in this case another cable 32 being stretched directly between the ends of the arms 3 and 4 and the block 26 riding on the cable 32 with a becket 34. In this case a simpler tackle with less mechanical advantage than that of FIG. 1 is shown. Normally there is no particular benefit from the arrangement of FIG. 3, which merely illustrates an equivalent effect without direct attachment of the block 26 on the outrigger.

FIG. 4 is a detailed view of the fastening of the cable 10 to the eye 13. The eye 13 is shown as an eye-bolt. The location of the hull where the eye-bolt 13 is placed is usually one that is reinforced for various reasons, so that special reinforcement is not usually necessary. Of course a U-bolt with both legs bolted through the hull could also be used. A shackle 14 passes through the eye 13. Preferably the shackle pin 15 is made captive by a cord or wire 42 and the shackle itself is loosely connected to the throat of the eye 13 by a cord or wire 43 to prevent either of these pieces from being lost overboard in the process of fastening or unfastening the cable 10. The cable 10 is provided at its mid-portion with a short piece of cable 38 bound at its ends by the usual "nicropress" fastenings 40 and 41 so as to hold in place a cringle 39 through which the shackle pin 15 may pass, thus keeping the shackle pin 15 from wearing away the surface of the cable 10.

It has already been mentioned that the outriggers are offset from the vertical by an angle of about 5 °. The axes of the pivots 5, 6, 7 and 8 of FIG. 1 and FIG. 2 are all vertical, however. When the outriggers are swung aft as partially shown in FIG. 7, discussed below, the weight of the arms and cables is shifted aft, changing the trim of the boat slightly and dipping the aft ends of the outriggers into the water, just enough to add a little stability tending to keep the boat straight upright, as may be convenient when it is docked with the outriggers folded in. In sailing position the outriggers just "kiss" the water level, as shown by the water level 30 drawn in on FIG. 2.

Figure 5:
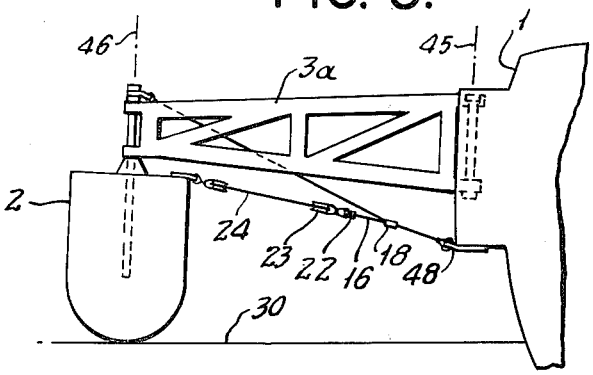
FIGS. 5 and 6 are diagrammatic vertical cross-sectional views of variations of the system illustrated in FIGS. 1 and 2.

Although it is preferred to rely on the effect just mentioned to provide sufficient stability or docking with outriggers alongside, it may be desired to accentuate the dipping of the outriggers into the water as they are brought alongside by additional means. FIG. 5 shows an arrangement in which the axes 45 and 46 of the pivots are parallel to the longitudinal plane of symmetry of the outrigger thus 5° off the vertical. The bottom of the arm **3*a*** when outstretched slants upward at 5°, but becomes almost level as the outrigger is brought alongside. This arrangement has the disadvantage of requiring more force to bring the outrigger alongside or to keep it fastened alongside because of the tendency of the buoyancy of the outrigger to cause the arms to swing out.

Another arrangement that could produce a similar effect is to rake the axes 46 and 45 slightly aft instead of slightly inwards. In any such case, the axes of all the pivots for swinging on outrigger must be parallel.

Figure 6:
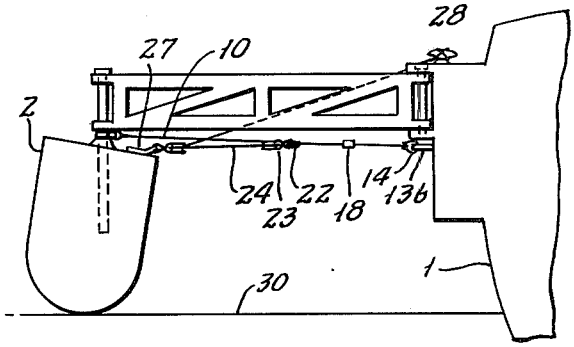

FIG. 6 illustrates that it is not necessary for the cable 10 to pull the ends of the arms downwards. In the case illustrated in FIG. 6, the cable 10 lies practically in the horizontal plane. Its ends are on the undersides of the ends of the arms 3 and 4 and the eye **13*b* on the main hull is fastened above where the inner top edge of the outrigger fits against the main hull 1 in the alongside position. In order to simplify the drawing the eye 13*b* is shown as just below the level of the bottom of the arm 3, but since the eye 13*b* is between the arms, in practice it could be located a little higher. It may not be desirable to have the cable 10 exert very much, if any, of a downward pull, because this downward pull, although it opposes the strains imposed on the arms by the lee outrigger, nevertheless adds to the strains imposed on the arms by the outrigger on the weather side. It is also possible to have a moderate downward pull by locating the eye on the main hull as just described in connection with FIG. 6, but locating the ends of the cable 10 at the top of the ends of the arms as in FIGS. 2 and 5**.

Figure 7:
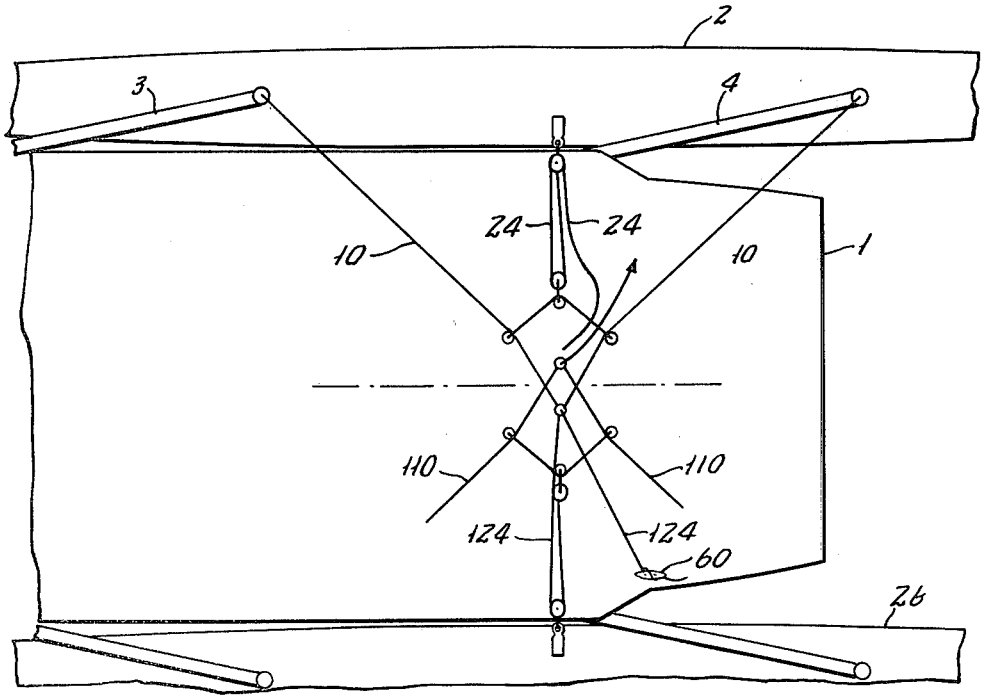
FIG. 7 is a diagrammatic plan view illustrating the use of the tension cable system of the present invention for securing the outriggers of a folding trimaran in their alongside positions.

FIG. 7 illustrates the use of the bracing cables and tackles of the present invention for securing the outriggers in their alongside position, particularly during road haulage on a trailer. The cable 10 for the starboard outrigger is showing as crossing over the cable 110 for the port outrigger in FIG. 7, because in the typical case, the beam of the main hull will be somewhat less than 6 feet and the arms may be, for example, 4 feet between pivots and spaced, for example, 8 feet apart. In this case the fall 24 of the tackle for the starboard outrigger is reeved through the midpoint eye of the cable 110 of the port outrigger in the manner shown by the loose condition of the fall 24 in FIG. 7 and then it is tightened as shown for the fall 124 of the tackle for the port outrigger by fastening to a cleat 60. Thus all of the cables and tackles are neatly disposed of during land transportation while serving at the same time to hold the outriggers alongside. In the diagrammatic showing above described, the presence of a yielding rubbing strip on the inside edge of the outriggers where it presses against the main hull 1, which is desirable, has not been shown in order to simplify the drawings.

Although the invention has been described with reference to several variations of the basic tension cable system for controlling the outrigger position, it will be evident that illustrations do not exhaust the possibilities of variation within the inventive concept.

I claim:

1. In a trimaran having outriggers each mounted with respect to the main hull on parallel hinged arms, a tension cable system for quickly and securely setting up each outrigger at the most extended position of each arm on which it is mounted and for quickly releasing the outrigger from its set-up position and bringing it alongside, comprising, in combination:

a fastening member anchored in the main hull on each side thereof substantially mid-way between the hull-mounted hinges respectively of the forwardmost and rearmost arms for each outrigger;

a cable for each outrigger anchored at both ends respectively at longitudinally spaced locations on the outrigger and having at substantially its midpoint a fastening member for detachable attachment to the nearer of said fastening members anchored in the main hull, said cable being of a length such as to provide for easy fastening together of said fastening members respectively of the cable and of the main hull when the corresponding outrigger is swung into approximately its set-up position;

means for detachably linking each fastening member anchored in the main hull with the fastening member of the corresponding cable;

a bridle for each cable having its ends riding on the cable respectively on opposite sides of said fastening member of the cable;

a tackle for each outrigger rigged between a block riding on said bridle and a block mounted so as to pull said outrigger evenly towards said main hull while tightening said cable symmetrically when the outrigger is set up, said tackle having a fall extending towards said main hull, and means on the main hull for tightening and releasably securing each said tackle fall to the main hull.

2. A tension cable set-up system as defined in claim 1 in which the locations at which the ends of each of said cables is anchored on an outrigger are the respective locations of the outrigger-mounted hinges or pivots of the forward and rear arms on which the outrigger is mounted with respect to the main hull.

3. A tension cable set-up system as defined in claim 1 in which said fastening member on the main hull is substantially nearer the waterline plane of the main hull for its straight upright position than are the locations at which said cable ends are anchored.

4. A tension cable set-up system as defined in claim 1 in which said bridle rides on said cable with the assistance of pulleys connected to the respective ends of the bridle and said block of said tackle rides on said bridle with the assistance of a rolling becket or pulley.

5. A tension cable set-up system as defined in claim 1 in which the length of each of said arms is between 40 and 60 percent of the spacing between respective connections of the forwardmost and rearmost arms to the outrigger mounted on said arms.

6. A tension cable set-up system as defined in claim 1 in which said outriggers are mounted on said arms so as to swing aft from the set-up position to an alongside position, and in which the hinges of said hinged arms for each outrigger have parallel hinge axes that are parallel to each other and within 5° of vertical for the upright position of said main hull.

7. A tension cable set-up system as defined in claim 6 in which said axes are substantially vertical for the upright position of said main hull.

* * * * *